US008449698B2

(12) United States Patent
Kim et al.

(10) Patent No.: US 8,449,698 B2
(45) Date of Patent: May 28, 2013

(54) DUAL PHASE STEEL SHEET AND METHOD OF MANUFACTURING THE SAME

(75) Inventors: Dong-Eun Kim, Chungcheongnam-do (KR); Jin-Sung Park, Chungcheongnam-do (KR); Hee-Joong Im, Gyeonggi-do (KR); Man-Been Moon, Gyeonggi-do (KR); Hyun-Woon Oh, Seoul (KR)

(73) Assignee: Hyundai Hysco, Ulsan (KR)

( * ) Notice: Subject to any disclaimer, the term of this patent is extended or adjusted under 35 U.S.C. 154(b) by 0 days.

(21) Appl. No.: 13/530,247

(22) Filed: Jun. 22, 2012

(65) Prior Publication Data

US 2012/0255654 A1 Oct. 11, 2012

Related U.S. Application Data

(62) Division of application No. 12/820,446, filed on Jun. 22, 2010.

(30) Foreign Application Priority Data

Aug. 31, 2009 (KR) ..... 10-2009-0081659

(51) Int. Cl.

| | |
|---|---|
| ***C21D 8/02*** | (2006.01) |
| ***C22C 38/38*** | (2006.01) |
| ***C22C 38/32*** | (2006.01) |
| ***C22C 38/02*** | (2006.01) |
| ***C22C 38/22*** | (2006.01) |

(52) U.S. Cl.
USPC ..... 148/603; 148/533; 148/328

(58) Field of Classification Search
USPC ..... 148/533, 603, 541, 547, 328
See application file for complete search history.

*Primary Examiner* — Jessee R. Roe
(74) *Attorney, Agent, or Firm* — Lowe Hauptman Ham & Berner, LLP

(57) ABSTRACT

The present disclosure relates to a dual phase steel sheet and a method of manufacturing the same. The steel sheet comprises C: 0.05~0.10% wt %, Si: 0.03~0.50 wt %, Mn: 1.50~2.00 wt %, P: greater than 0 wt %~0.03 wt %, S: greater than 0 wt %~0.003 wt %, Al: 0.03~0.50 wt %, Cr: 0.1~0.2 wt %, Mo: 0.1~0.20 wt %, Nb: 0.02~0.04 wt %, B: greater than 0 wt %~0.005 wt %, N: greater than 0 wt %~0.01 wt %, and the balance of Fe and other unavoidable impurities. To impart excellent formability, bake hardenability, dent resistance, high Ri value and plating characteristics to the steel sheet for exterior and interior panels of automobiles, the steel sheet is processed to have a dual phase structure through cold rolling, annealing, and hot-dip galvanizing.

8 Claims, 3 Drawing Sheets

DUAL PHASE STEEL SHEET AND METHOD OF MANUFACTURING THE SAME

CROSS REFERENCE TO RELATED APPLICATION

This application is a divisional of U.S. application Ser. No. 12/820,446, entitled "Dual Phase Steel Sheet and Method of Manufacturing the Same," filed Jun. 22, 2010.

BACKGROUND OF THE INVENTION

1. Field of the Invention

The present invention relates to a dual phase steel sheet and a method of manufacturing the same and, more particularly, to a technique for imparting dent resistance, low yield strength, high Ri value (Lankford value) and high formability to steel sheets for exterior and interior panels of automobiles.

2. Description of the Related Art

Since steel sheets for automobiles are generally subjected to pressing, the steel sheets are required to have excellent press formability, which is guaranteed by securing high ductility and high Ri value. In other words, the steel sheets for automobiles are high strength steel sheets and it is most important that they have both high ductility and high Ri value.

However, in high strength steel sheets satisfying requirements for weight reduction and passenger safety, the amount of alloy components such as Si and Mn increases and causes deterioration of formability and severe deterioration of plating characteristics, thereby making it difficult to produce steel sheets for automobiles that satisfy all of these requirements.

Since the steel sheets for automobiles are also required to have high corrosion resistance, hot-dip galvanized steel sheets exhibiting good corrosion resistance have been used in the industry. The hot-dip galvanized steel sheet is produced using continuous hot-dip galvanizing equipment, which performs recrystallization annealing and galvanizing on the same line, so that the hot-dip galvanized steel sheet has good corrosion resistance and can be processed at low cost. Further, a hot-dip galvannealing steel sheet produced through hot-dip galvanizing and reheating is also widely used due to its good weldability and formability in addition to good corrosion resistance.

As described above, to further reduce the weight of an automobile body while strengthening the body, there is strong demand for the development of high strength cold-rolled steel sheets having excellent formability and high strength hot-dip galvanized steel sheets having excellent corrosion resistance through a continuous hot-dip galvanizing line.

Recently, in the automotive industries, high strengthening of structural components and exterior panels for automobiles have been rapidly progressed in the course of attempting to achieve weight reduction and quality enhancement of automobiles. Here, there is demand for the provision of high strength steel sheets having good dent resistance to increase resistance to impact, which is caused by collision with an external object and results in damage of the exterior panel, by application of high strength steel to the exterior panel.

Further, since precise formation is important for an external appearance of an automobile, there is demand for the provision of bake hardening steel (BH steel) that has low strength to permit easy formation before painting and has increased strength after painting. Currently, the BH steel is developed to have a tensile strength of about 35~450 MPa.

One example of high strength hot-dip galvanized steel sheets is a steel sheet that has a dual phase of soft ferrite and hard martensite and is produced by a method of manufacturing a hot-dip galvanized steel sheet having improved elongation (El) and Ri value (Lankford value). However, this technique cannot guarantee good galvanizing quality due to excess Si in the steel sheet and suffers from a problem of high manufacturing costs due to addition of a large amount of Ti and the like.

SUMMARY OF THE INVENTION

The present invention is conceived to solve the problems of the related art, and an aspect of the invention is to provide a dual phase steel sheet and a method of manufacturing the same, which is produced as an annealed steel sheet and a hot-dip galvanized steel sheet, comprises C: 0.05~0.10% by weight (wt %), Si: 0.03~0.50 wt %, Mn: 1.50~2.00 wt %, P: greater than 0 wt %~0.03 wt %, S: greater than 0 wt %~0.003 wt %, Al: 0.03~0.50 wt %, Cr: 0.1~0.2 wt %, Mo: 0.1~0.20 wt %, Nb: 0.02~0.04 wt %, B: greater than 0 wt %~0.005 wt %, N: greater than 0 wt %~0.01 wt %, and the balance of Fe and other unavoidable impurities, and has a yield strength (YS) of 270 MPa or more, a tensile strength (TS) of 440~590 MPa, an elongation (El) of 28%, a work hardening index (n) of 0.15~0.2, and an Ri value (Lankford value) of 1.0~2.0.

In accordance with an aspect of the invention, a dual phase steel sheet for interior and exterior panels of automobiles comprises C: 0.05~0.10% by weight (wt %), Si: 0.03~0.50 wt %, Mn: 1.50~2.00 wt %, P: greater than 0 wt %~0.03 wt %, S: greater than 0 wt %~0.003 wt %, Al: 0.03~0.50 wt %, Cr: 0.1~0.2 wt %, Mo: 0.1~0.20 wt %, Nb: 0.02~0.04 wt %, B: greater than 0 wt %~0.005 wt %, N: greater than 0 wt %~0.01 wt %, and the balance of Fe and other unavoidable impurities, and has a tensile strength (TS) of 440~590 MPa.

Here, the dual phase steel sheet may have a yield strength (YS) of 270 MPa or more, an elongation (El) of 28%, a work hardening index (n) of 0.15-0.2, and an Ri value of 1.0~2.0.

In accordance with another aspect of the invention, a method of manufacturing a dual phase steel sheet for interior and exterior panels of automobiles includes: reheating a steel slab, the steel slab comprising C: 0.05~0.10% by weight (wt %), Si: 0.03~0.50 wt %, Mn: 1.50~2.00 wt %, P: greater than 0 wt %~0.03 wt %, S: greater than 0 wt %~0.003 wt %, Al: 0.03~0.50 wt %, Cr: 0.1~0.2 wt %, Mo: 0.1~0.20 wt %, Nb: 0.02~0.04 wt %, B: greater than 0 wt %~0.005 wt %, N: greater than 0 wt %~0.01 wt %, and the balance of Fe and other unavoidable impurities; hot-rolling the steel slab to prepare a hot-rolled steel sheet; coiling the hot-rolled steel sheet to prepare a hot-rolled coil; picking and cold-rolling the steel sheet after uncoiling the hot-rolled coil to prepare a cold-rolled steel sheet; annealing the cold-rolled steel sheet to prepare an annealed steel sheet having a dual phase; and hot-dip galvanizing and galvannealing the annealed steel sheet.

The steel slab may be produced by preparing molten steel through a steel making process, followed by making an ingot using the molten steel or continuous casting the molten steel. The reheating may be performed at 1150~1250° C. for 1.5~3.5 hours. The hot rolling may be five-pass hot rolling performed at 800~900° C. The coiling may be performed at 550-650° C. and the cold-rolling may be performed at a reduction ratio of 50-80%.

The annealing may be performed on a continuous annealing line, and the continuous annealing line includes an annealing line on which the steel sheet is heated to a temperature of 750~850° C. at 10~20° C./sec and annealed for 100~110 seconds, a cooling line on which the annealed steel sheet is cooled to 460~540° C. at 3~15° C./sec, and an over-aging line on which the cooled steel sheet is subjected to over-aging at 460~540° C. for 100~200 seconds. The method may further include hot-dip galvanizing the annealed steel sheet at 480~560° C.

In this method, the continuous annealing line may be operated at a line speed (L/S) of 80~200 mpm.

BRIEF DESCRIPTION OF THE DRAWINGS

The above and other aspects, features and advantages of the invention will become apparent from the following detailed description in conjunction with the accompanying drawings, in which.

DETAILED DESCRIPTION OF THE EMBODIMENTS

Figure 1:
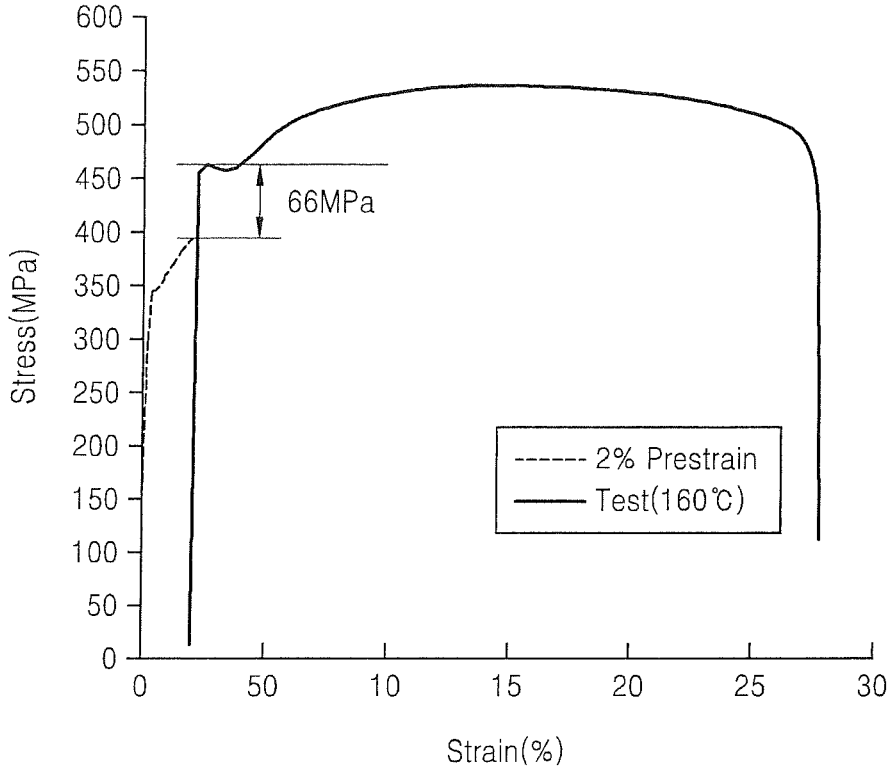
FIG. 1 is a representative graph depicting bake hardening characteristics depending on a composition system of a dual phase steel sheet in accordance with the present invention.

Embodiments of the invention will now be described in detail with reference to the accompanying drawings.

Current BH steel is produced to exhibit bake hardenability by adjusting the amount of carbon (C) dissolved in extremely low carbon steel, but confronts a difficulty in increasing tensile strength (TS) above 440 MPa, which is currently obtained by the BH steel. The reason behind this is that not only does a single ferrite phase of the current BH steel cause a limit in increasing the strength of the BH steel, but also carbon dissolved in the single phase makes it difficult to obtain a high BH value. Further, since an increase in degree of fanning the steel sheet for automobiles causes a decrease in BH value of the extremely low carbon BH steel, it is also difficult to employ a technique of increasing strength of external panels for automobiles based on both work hardening and bake hardening. Moreover, an aging phenomenon caused by carbon and nitrogen can be prevented over time.

To solve such problems of the current BH steel, the present invention provides a multi-phase steel sheet that has multiple phases instead of a single ferrite phase.

Examples of Multi-Phase (MP) steel include TRIP steel and DP steel, both of which are produced by maximizing the BH characteristics and enable the provision of steel sheets exhibiting higher strength than and superior characteristics to the current BH steel. However, these steels are produced for the purpose of structural components and are rarely produced for exterior panels for automobiles. In addition, since a rear side of the exterior panel herein constitutes an interior panel, it should be understood that the steel sheet can be equally applied to both the exterior panel and the interior panel.

Accordingly, the present invention is directed to providing a material for interior and exterior panels for automobiles, which has good formability and a high BH value by adjusting a composition of DP steel while properly setting work conditions.

In this invention, the amount of Si deteriorating ductility, weldability and wettability of a steel sheet is minimized among impurity elements in the steel, and the amount of Al is adjusted to improve the wettability.

Here, since silicon is a ferrite stabilization element, mechanical properties can be deteriorated. Thus, Al having the same effect as the Si is added to the steel in an amount that may not cause clogging of a nozzle during casing while controlling the content of AlN. The addition of Al results in cleaning effects of ferrite and provides stable fractions of austenite and ferrite in a dual phase region through enrichment of carbon and other chemical components in grain boundaries of ferrite during heat treatment while retarding transformation of austenite into pearlite by enhancing hardenability of martensite upon rapid cooling.

Further, ferrite refinement and strength enhancement can be obtained by addition of Mo. Here, the ferrite and martensite phases may be further stabilized by adding Al and Cr in addition to Mo. Thus, the dual phase steel sheet may have satisfactory mechanical properties and improved formability.

In addition, when the amount of nitrogen (N) is controlled to be in the range of greater than 0 wt %~0.01 wt %, the nitrogen serves as an austenite stabilization element promoting martensite transformation during quenching and the strength is increased by enrichment of N in martensite, so that the steel has improved elongation while maintaining the same level of strength. Bake hardenability is also increased by dissolved N after painting. In this invention, the formation of AlN caused by addition of a large amount of Al is suppressed by controlling the amount of nitrogen (N) to be in the range of greater than 0 wt %~0.01 wt %, so that the steel sheet is prevented from increasing in strength after hot rolling and may be applied to exterior panels of automobiles which require high strength and high toughness. As a result, the present invention provides steel sheets that have excellent formability and bake hardenability by increasing not only the bake hardenability but also a BH value through suitable addition of N to the steel sheet.

Next, a dual phase steel sheet and a method of manufacturing the same according to the invention will be described in detail with reference to the drawings and tables.

The dual phase steel sheet according to the invention has improved mechanical properties such as yield strength (YS), tensile strength (TS) and elongation (El) according to the composition of the steel sheet. Next, chemical components of the steel sheet according to the invention will be described in detail.

[Main Components]

Carbon (C): 0.05~0.10 wt %

Carbon is an austenite stabilization element and minimizes formation of carbides within pearlite and ferrite structures in a hot-rolled coil while enabling refinement of crystal grains. Composite precipitates partially melted and dissolved again during annealing a cold-rolled steel sheet appears in fine crystal grains of 10~3 μm or grain boundaries. Here, an optimal amount of carbon for enabling development of (111) textures providing good formability by limiting martensite to 20% or less in steel is in the range of 0.05~0.10 wt %.

If the content of carbon (C) is less than 0.05 wt %, stable austenite is not formed in a critical temperature region, so that martensite is not fondled in a proper volume fraction after quenching, thereby making it difficult to secure desired strength. If the carbon content exceeds 0.10 wt %, the steel sheet cannot guarantee ductility and has deteriorated weldability. Thus, the content of carbon may be in the range of 0.05~0.10 wt %.

Silicon (Si): 0.03~0.50 wt %

Silicon is a ferrite stabilization element and increases strength of steel by solid solution hardening. Further, silicon suppresses cementite precipitation during annealing at 640~820° C. and promotes enrichment of carbon in austenite to contribute in formation of martensite upon quenching while enhancing ductility.

If the content of silicon (Si) is less than 0.03 wt %, austenite stabilization effects are weakened, and if the content of silicon exceeds 0.50 wt %, surface roughness is deteriorated and silicon oxide is enriched, thereby significantly deteriorating weldability and wettability. Thus, the content of silicon may be in the range of 0.03~0.50 wt %.

Manganese (Mn): 1.50~2.00 wt %

Manganese is an austenite stabilization element and retards transformation of austenite to pearlite when the steel sheet is cooled to 460~540° C. after annealing, thereby allowing a stable martensite structure to be obtained while the steel sheet is quenched to room temperature. Further, the manganese increases strength by solid solution hardening and combines with sulfur (S) to form MnS inclusions, which are conductive in preventing hot cracking of a steel slab.

If the content of manganese (Mn) is less than 1.50 wt %, it is difficult to retard the transformation of austenite to pearlite, and if the content of manganese (Mn) exceeds 2.0 wt %, the price of steel slabs significantly increases, and weldability and formability are deteriorated along with wettability. Thus, the content of manganese (Mn) may be in the range of 1.50~2.00 wt %.

Chromium (Cr): 0.1~0.2 wt %

Chromium is effective in stable formation of low temperature transformation phases by enhancing hardenability. Further, chromium provides various effects, such as carbide refinement, retardation of spheroidization speed, grain refinement, grain growth suppression, and ferrite strengthening. Additionally, the chromium is effective to suppress softening of a heat affected zone (HAZ) upon welding.

If the content of chromium (Cr) is less than 0.1 wt %, it is difficult to dissolve the chromium again due to significantly low combination with carbon (C), and if the content of chromium (Cr) exceeds 0.2 wt %, the heat affected zone undergoes a significant increase in hardness. Thus, the content of chromium (Cr) may be in the range of 0.10~0.20 wt %.

Aluminum (Cr): 0.03~0.50 wt %

Aluminum is used as a deoxidizer and suppresses cementite precipitation while stabilizing austenite like silicon (Si). Since aluminum enables refinement of carbides and grain boundaries of a hot-rolled coil, the aluminum allows unnecessary nitrogen dissolved in steel to be precipitated as AlN. As a result, the aluminum increases strength of the steel.

If the content of aluminum (Al) is less than 0.03 wt %, there will be no austenite stabilization effect, and if the content of aluminum (Al) exceeds 0.50 wt %, nozzle clogging can occur during steel making, and hot embrittlement occurs due to Al oxides during casting, thereby causing generation of cracks and deterioration in ductility.

Thus, the content of aluminum (Al) may be in the range of 0.03~0.50 wt % to permit grain boundary segregation in high temperature regions.

Phosphorus (P): 0.03 wt % or less

Phosphorus (P) enhances strength of the steel sheet through solid solution strengthening, is effective in suppressing cementite precipitation in combination with Si during an annealing process at 640~820° C., and promotes enrichment of carbon in austenite. Thus, the phosphorous (P) is added in an amount of 0.03 wt % or less.

Herein, it should be noted that the term "or less" means "exceeds 0" since at least some amount must be added to the steel sheet. If the content of phosphorus (P) exceeds 0.03 wt %, there occurs secondary work embrittlement and deterioration in adhesion of zinc galvanizing, thereby deteriorating alloying properties. Thus, the content of phosphorus is limited to 0.03 wt % or less.

Molybdenum (Mo): 0.10~0.20 wt %

Molybdenum (Mo) causes complex precipitation with other elements during cooling after hot-rolling. Since molybdenum has a low melting temperature, it is added to allow carbon combined with the molybdenum to be re-melted and dissolved again in complex precipitates during the annealing. Molybdenum fauns ferrite grain boundaries in a dual phase region through refinement of ferrite grains, and forms enriched martensite in a stabilized region to form movable dislocations. Further, molybdenum may guarantee strength of the steel sheet through grain refinement without deterioration of ductility.

If the content of molybdenum (Mo) is less than 0.10 wt %, the aforementioned effects of molybdenum cannot be obtained. Further, if the content of molybdenum exceeds 0.20 wt %, manufacturing costs increase and there can be a difficulty in casting.

Niobium (Nb): 0.02~0.04 wt %

Niobium (Nb) is melted again during annealing after hot rolling and cold rolling to allow carbon combined with niobium to be dissolved again in complex precipitates, thereby contributing to refinement of crystal grains and formation of martensite through formation of complex precipitates.

If the content of niobium (Mo) is less than 0.02 wt %, the aforementioned effects of molybdenum cannot be obtained, and if the content of niobium exceeds 0.04 wt %, manufacturing costs increases and complex carbides are increasingly formed instead of martensite, making it difficult to manufacture dual phase steel.

Boron (B): 0.005 wt % or less

Boron (B) contributes to the formation of martensite and even small amounts thereof can enhance hardenability. Herein, it should be noted that the term "or less" means "exceeds 0" since at least some amount must be added to the steel sheet.

If the content of boron (B) exceeds 0.005 wt %, a great amount of martensite can be formed, making it difficult to guarantee desired ductility.

A steel slab having the composition described above is prepared by obtaining molten steel through steel making, followed by ingot making or continuous casting. To produce a steel sheet having desired properties, the steel slab is subjected to hot rolling, coiling, cold rolling, annealing, and hot-dip galvanizing, details of which will be described hereinafter.

[Hot Rolling]

For hot rolling the slab having the composition described above, the slab is reheated at 1150~1250° C. for 1.5~3.5 hours.

Finish hot rolling is performed at $Ar_3$ transformation temperature or less, followed by cooling to obtain fine hot-rolled structures. Here, when the hot rolling is performed at the $Ar_3$ transformation temperature or less, it is performed at a temperature of 800~900° C. with reference to 910° C., which is the finish hot rolling temperature in this invention. The hot rolling may be performed by passing the slab five times.

If the finish hot rolling temperature is low, the hot rolling is carried out in an austenite zone or less and drawing properties are deteriorated due to asymmetrical development of crystal grains. Thus, the hot rolling is performed at a proper temperature to obtain a fine hot-rolled structure. After the hot rolling, surface scales may be removed from the steel sheet by a scale removing apparatus at high pressure or by strong acid pickling.

[Coiling]

In this invention, the hot-rolled steel sheet is subjected to coiling at 550~650° C. to prepare a hot-rolled coil. In the hot-rolled coil, carbides are smoothly farmed to minimize a dissolved amount of carbon while allowing maximum precipitation of AlN to thereby minimize formation of dissolved nitrogen. Such a coiling temperature is determined to obtain a structure for optimal mechanical properties after cold rolling and recrystallization heat treatment. If the coiling temperature is less than 550° C., cold rolling is difficult due to bainite or martensite, and if the coiling temperature exceeds 650° C., the final microstructure is coarsened, making it difficult to manufacture a steel sheet having sufficient strength.

[Cold Rolling]

The hot-rolled coil is uncoiled for acid pickling and cold rolling Here, the cold rolling may be performed at a reduction ratio of 50~80%. The cold rolling deforms the hot-rolled structure in the steel sheet, at which deformation energy becomes energy for recrystallization. If the reduction ratio is less than 50%, the deformation of the hot-rolled structure is not sufficient, and cold rolling at a reduction ratio exceeding 80% cannot be realized in practice. Further, during the cold rolling, complex precipitates in the hot-rolled coil are decomposed to allow (100) textures to grow at an initial state of recrystallization, thereby causing deterioration in drawing properties while increasing possibility of edge cracking and fracture of the steel sheet. Accordingly, the reduction ratio may be in the range of 50~80%.

[Annealing and Hot-Dip Galvanizing]

In this invention, the cold-rolled steel sheet is subjected to recrystallization annealing. The annealing may be performed on a continuous annealing line (CAL). The continuous annealing line (CAL) may be a combined line including a continuous galvanizing line (CGL) or a continuous vertical galvanizing line (CVGL).

Annealing enhances drawing properties by development of the (111) textures through recrystallization and grain growth, and allows elution of dissolved carbon by re-melting fine complex precipitates. The annealing is performed at a temperature between Ac1 transformation temperature and Ac3 transformation temperature to form a double-phase of ferrite and austenite.

The continuous annealing line satisfying this condition includes an annealing line on which the cold-rolled steel sheet is heated to 750~850° C. at 10~20° C./sec and annealed for 100~110 seconds, a cooling line on which the annealed steel sheet is cooled to 460~540° C. at 3~15° C./sec, and an over-aging line on which the cooled steel sheet is subjected to over-aging at 460~540° C. for 100~200 seconds.

Next, the method may further include hot-dip galvanizing. This process may be performed at 480~560° C.

In the continuous annealing line, the steel sheet satisfies a degree of alloying (Fe %) in the range of 8~15% only when the hot-dip galvanizing is performed at 480~560° C. Here, processing time for alloying is limited to 2 minutes or less.

If the processing time for alloying exceeds 2 minutes, an excessive amount of bainite or carbides is precipitated and deteriorates mechanical properties. If the degree of alloying (Fe %) is less than 8%, the hot-dip galvanizing process becomes meaningless, and if the degree of alloying (Fe %) exceeds 15%, the steel sheet can suffer severe powdering and flaking phenomena during working thereof.

As described above, the continuous annealing line according to the invention may operate at an overall line speed (L/S) of 80~200 mpm. If the line speed is less than 80 mpm, the formation of martensite is difficult due to too low a speed, and if the line speed exceeds 200 mpm, the steel sheet suffers negative Zn—Fe diffusion due to too high a speed upon heating after the hot-dip galvanizing.

Further, since it is possible to perform the continuous annealing and hot-dip galvanizing (CAL/CGL) on a single line, these processes may be more easily carried out on a complex line capable of easily controlling time and temperature for heat treatment.

Among the processes of the invention, the annealing process will hereinafter be described in more detail. Herein, an annealing line is indicated by SS (soaking section), a skin pass rolling line is indicated by SPM (skin pass mill), a primary cooling line is indicated by GJS (gas jet section), a secondary cooling line is indicated by RQS (roll quenching section), an over-aging line is indicated by OAS (over-aging section), and a hot-dip galvanizing line is indicated by GA (galvannealed).

Through these lines, a hot-dip galvannealed dual phase steel sheet may be manufactured to have excellent wettability and surface quality, a tensile strength of 440~590 Mpa, an elongation (El) of 28~32%, and an Ri value of 1.15~0.2 while satisfying a martensite volume fraction of 5~20% in the microstructure of the steel sheet.

Hereinafter, annealed steel sheets and hot-dip galvannealed steel sheets produced from the dual phase steel sheet obtained by the above processes will be referred to as "heat-treated steel sheet," and chemical components of heat-treated steel sheets according to the invention are listed in Table 1.

TABLE 1

| | Components (wt %) | | | | | | | | | |
|---|---|---|---|---|---|---|---|---|---|---|
| | C | Si | Mn | P | S | Al | Cr | Mo | Nb | remark |
| Example 1 | 0.06 | 0.03 | 1.6 | 0.01 | 0.003 | 0.10 | | | | |
| Example 2 | 0.06 | 0.20 | 1.6 | 0.01 | 0.003 | 0.05 | | | | |
| Example 3 | 0.06 | 0.40 | 1.6 | 0.01 | 0.003 | 0.03 | | | | |
| Example 4 | 0.06 | 0.03 | 1.4 | 0.01 | 0.003 | 0.04 | | | | |
| Example 5 | 0.06 | 0.05 | 1.8 | 0.01 | 0.003 | 0.03 | | | | |
| Example 6 | 0.04 | 0.04 | 1.6 | 0.01 | 0.003 | 0.03 | 0.20 | | | |
| Example 7 | 0.04 | 0.20 | 1.6 | 0.01 | 0.003 | 0.03 | 0.20 | | | |
| Example 8 | 0.10 | 0.05 | 1.6 | 0.01 | 0.003 | 0.05 | 0.20 | | | |
| Example 9 | 0.06 | 0.05 | 1.6 | 0.01 | 0.003 | 0.03 | 0.20 | | | |
| Example 10 | 0.06 | 0.08 | 1.6 | 0.01 | 0.003 | 0.05 | 0.40 | | | |
| Example 11 | 0.06 | 0.05 | 1.6 | 0.01 | 0.003 | 0.05 | | | 0.02 | |
| Example 12 | 0.06 | 0.05 | 1.6 | 0.01 | 0.003 | 0.03 | | | 0.04 | |
| Example 13 | 0.06 | 0.03 | 1.6 | 0.03 | 0.003 | 0.05 | | | 0.02 | |
| Example 14 | 0.08 | 0.03 | 1.6 | 0.01 | 0.003 | 0.05 | 0.20 | | | |
| Example 15 | 0.06 | 0.20 | 1.6 | 0.01 | 0.003 | 0.03 | 0.20 | | | |
| Example 16 | 0.06 | 0.03 | 1.6 | 0.01 | 0.003 | 0.03 | | 0.10 | | B: 0.002 |
| Example 17 | 0.06 | 0.03 | 1.6 | 0.01 | 0.003 | 0.05 | 0.20 | 0.10 | | |
| Example 18 | 0.06 | 0.05 | 1.6 | 0.01 | 0.003 | 0.03 | | | | B: 0.002 |
| Example 19 | 0.06 | 0.05 | 1.6 | 0.01 | 0.003 | 0.05 | 0.10 | 0.10 | | B: 0.002 |

TABLE 1-continued

| | Components (wt %) | | | | | | | | | |
|---|---|---|---|---|---|---|---|---|---|---|
| | C | Si | Mn | P | S | Al | Cr | Mo | Nb | remark |
| Example 20 | 0.06 | 0.10 | 1.6 | 0.02 | 0.003 | 0.50 | | 0.10 | | |
| Example 21 | 0.06 | 0.10 | 1.6 | 0.01 | 0.003 | 0.50 | | 0.20 | | |
| Example 22 | 0.06 | 0.10 | 1.6 | 0.01 | 0.003 | 0.20 | | 0.10 | | |
| Example 23 | 0.06 | 0.10 | 1.6 | 0.01 | 0.003 | 0.03 | 0.2 | 0.10 | | |
| Example 24 | 0.06 | 0.10 | 1.6 | 0.01 | 0.003 | 0.10 | 0.1 | 0.10 | | |
| Example 25 | 0.08 | 0.12 | 1.6 | 0.01 | 0.003 | 0.53 | | 0.10 | | |
| Comparative Example 1 | 0.08 | 0.12 | 1.6 | 0.01 | 0.003 | 0.6 | 0.50 | | | |

N: greater than 0 wt %~0.01 wt %

Combinations of chemical components of Examples 1 to 25 provided suitable properties for manufacturing dual phase steel sheets, each of which has ferrite and martensite structures. In the above examples, empty spaces indicate content ratios according to the invention, and are preferably assumed to have the minimum components.

However, Comparative Example 1 exhibited undesired properties, and it was found that Comparative Example 1 was different from Example 25 in terms of the content of Al+Cr.

Namely, the dual phase steel sheet of the invention may have improved properties by adjusting the content of Al+Cr, and it can be seen from Comparative Example 1 that the content of Al+Cr is adjusted to be less than 1.0 wt % to guarantee the improved properties.

If the content of Al+Cr is 1 wt % or more in the steel sheet, casting cannot be performed due to clogging of a nozzle during continuous casting and MN can be precipitated to cause cracks during the continuous casting or hot rolling. Further, if Al and Cr are added in an excessive amount, it may become difficult to obtain a desired volume fraction of martensite due to an increase in hardenability.

Next, cold-rolled steel sheets having the above components were prepared and subjected to measurement of mechanical properties. The results are listed in Table 2.

As shown in Table 2, the annealed steel sheets of the inventive examples have a yield strength of 297~533 Mpa, a tensile strength of 443~604 Mpa and an elongation (El) of 21~36%, and satisfy requirements for the dual phase cold-rolled steel sheet according to the invention. The annealed steel sheets of the inventive examples exhibit desired values that the present invention is intended to achieve.

Here, in terms of the tensile strength (TS), the inventive examples satisfy a target value of the invention, that is, a level of 440~590 MPa. This result will be described in more detail using samples of representative inventive examples with reference to Table 3.

FIG. 1 is a representative graph depicting bake hardening characteristics depending on a composition system of a dual phase steel sheet in accordance with the present invention.

Referring to FIG. 1, for each of the annealed steel sheets obtained from Examples 1 to 25, mechanical properties with a prestrain of 2% were compared with the mechanical properties after bake hardening at 160° C. The results are described using some representative examples with reference to Table 3.

TABLE 2

| | SS: 780° C. | | | SS: 800° C. | | | SS: 820° C. | | |
|---|---|---|---|---|---|---|---|---|---|
| | YS (MPa) | TS (MPa) | El (%) | YS (MPa) | TS (MPa) | El (%) | YS (MPa) | TS (MPa) | El (%) |
| Example 1 | 330 | 452 | 32 | 323 | 447 | 33 | 332 | 451 | 32 |
| Example 2 | 345 | 466 | 29 | 353 | 470 | 31 | 362 | 469 | 31 |
| Example 3 | 377 | 497 | 30 | 386 | 490 | 31 | 384 | 496 | 30 |
| Example 4 | 324 | 444 | 34 | 330 | 443 | 36 | 330 | 447 | 34 |
| Example 5 | 338 | 474 | 31 | 344 | 470 | 34 | 350 | 476 | 33 |
| Example 6 | 297 | 449 | 34 | 303 | 450 | 34 | 313 | 451 | 35 |
| Example 7 | 323 | 467 | 31 | 322 | 466 | 33 | 337 | 464 | 34 |
| Example 8 | 349 | 489 | 30 | 362 | 489 | 31 | 360 | 492 | 31 |
| Example 9 | 335 | 453 | 32 | 335 | 454 | 31 | 335 | 449 | 33 |
| Example 10 | 329 | 469 | 32 | 324 | 468 | 31 | 333 | 460 | 32 |
| Example 11 | 410 | 502 | 28 | 407 | 499 | 28 | 400 | 486 | 29 |
| Example 12 | 506 | 578 | 21 | 501 | 556 | 21 | 473 | 533 | 23 |
| Example 13 | 427 | 520 | 26 | 422 | 506 | 26 | 419 | 503 | 28 |
| Example 14 | 355 | 476 | 31 | 356 | 472 | 30 | 353 | 471 | 31 |
| Example 15 | 345 | 488 | 30 | 351 | 482 | 28 | 370 | 484 | 30 |
| Example 16 | 337 | 462 | 30 | 349 | 462 | 29 | 354 | 463 | 30 |
| Example 17 | 352 | 501 | 30 | 355 | 494 | 30 | 363 | 487 | 30 |
| Example 18 | 322 | 450 | 34 | 330 | 448 | 32 | 334 | 448 | 30 |
| Example 19 | 347 | 488 | 31 | 341 | 481 | 31 | 357 | 488 | 31 |
| Example 20 | 350 | 512 | 34 | 345 | 520 | 33 | 355 | 525 | 33 |
| Example 21 | 341 | 597 | 33 | 344 | 599 | 32 | 350 | 604 | 33 |
| Example 22 | 355 | 510 | 34 | 366 | 504 | 32 | 359 | 510 | 32 |
| Example 23 | 337 | 520 | 34 | 342 | 518 | 31 | 354 | 509 | 32 |
| Example 24 | 346 | 502 | 31 | 358 | 496 | 32 | 355 | 495 | 34 |
| Example 25 | 357 | 594 | 30 | 363 | 592 | 31 | 361 | 603 | 36 |

TABLE 3

| | YS (MPa) | TS (MPa) | EL (%) | n | Ri | YR (%) | BH (MPa) | Al (MPa) |
|---|---|---|---|---|---|---|---|---|
| Example 22 | 359 | 510 | 32 | 0.184 | 1.13 | 73 | 50 | 39 |
| Example 23 | 354 | 509 | 32 | 0.184 | 1.18 | 66 | 66 | 44 |
| Example 24 | 355 | 495 | 34 | 0.191 | 1.20 | 72 | 48 | 36 |
| Example 25 | 361 | 603 | 36 | 0.201 | 1.09 | 65 | 55 | 44 |

In Table 3, the composition of each example is the same as that listed in Table 1. In these examples, C, Si, Mn, P, S and N were provided as main components, and Al, Cr, B and Mo were provided as additional components for embodying dual phase steel sheets having formability, bake hardenability, dent resistance, high Ri value (Lankford value) and plating characteristics. As a result, it was found that the examples satisfied a yield strength (YS) of 297~533 MPa, a tensile strength (TS) of 443~604 MPa, an elongation (El) of 21~36%, a work hardening index (n) of 0.15~0.20, and an Ri value (Lankford value) of 1.0~2.0. In the example and the comparative example, to which Al was added in a relatively large amount, the tensile strength exceeded 590 MPa, which resulted in a work hardening index above 0.2.

For Examples 22 and 25, since Si and Mo were added in large amounts for producing dual phase steel for interior and exterior panels, formability was relatively deteriorated as compared with other examples, but wettability was improved due to the addition of Al.

Figure 2:
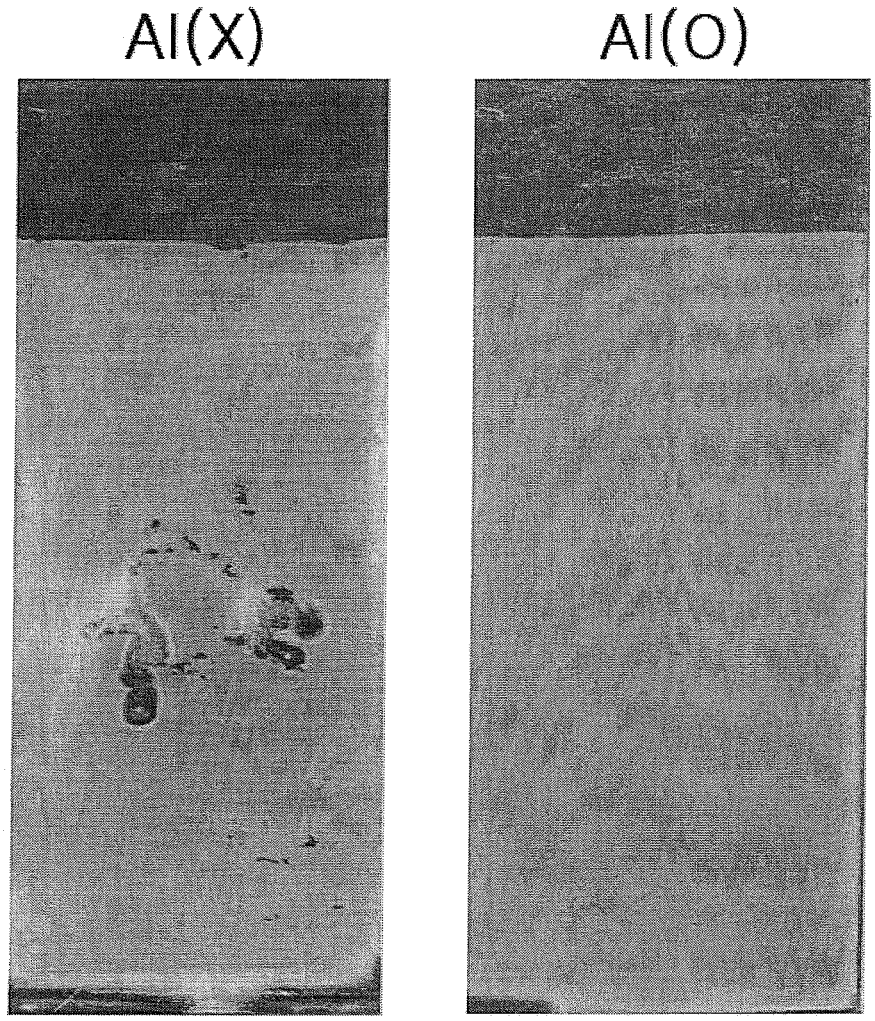
FIG. 2 is pictures showing test results of wettability upon addition of Al in accordance with the present invention.

FIG. 2 is pictures of test results of wettability by Al addition in accordance with the present invention.

Referring to FIG. 2, it can be seen that the wettability is remarkably improved depending on the addition of Al.

Table 4 shows that the mechanical properties are significantly influenced by cooling capability, which is one of the most important factors in manufacturing dual phase steel. Variations in mechanical properties of Examples 22 to 25 were observed depending on cooling temperature, and results showed that Examples 22 to 25 were not significantly sensitive to the temperature and had desired mechanical properties of the invention at a level of 440~590 MPa.

TABLE 4

| | | RQS (° C.) | YP (MPa) | TS (MPa) | EL (%) | N | Ri |
|---|---|---|---|---|---|---|---|
| #22 | Example 22-1 | 540 | 360 | 508 | 31.9 | 0.197 | 1.12 |
| | Example 22-2 | 500 | 378 | 503 | 31.2 | 0.191 | 1.12 |
| | Example 22-3 | 460 | 359 | 510 | 32 | 0.184 | 1.13 |
| #23 | Example 23-1 | 540 | 339 | 531 | 30.8 | 0.185 | 1.20 |
| | Example 23-2 | 500 | 333 | 519 | 32.2 | 0.189 | 1.19 |
| | Example 23-3 | 460 | 354 | 509 | 32 | 0.184 | 1.18 |
| #24 | Example 24-1 | 540 | 339 | 495 | 33.0 | 0.182 | 1.23 |
| | Example 24-2 | 500 | 352 | 492 | 32.1 | 0.175 | 1.27 |
| | Example 24-3 | 460 | 355 | 495 | 34 | 0.191 | 1.20 |
| #25 | Example 25-1 | 540 | 373 | 632 | 30 | 0.186 | 1.09 |
| | Example 25-2 | 500 | 369 | 611 | 33 | 0.181 | 1.12 |
| | Example 25-3 | 460 | 361 | 603 | 36 | 0.174 | 1.19 |

Herein, as a pre-stage for measuring the yield strength (YS), a yield point was measured, and it could be seen that the examples satisfied all requirements of the present invention in view of tensile strength (TS), elongation (El) and yield ratio (YR).

As such, in this invention, the amounts of components, such as Al, Cr, Nb, B and Mo, are adjusted to form a dual phase steel sheet, which in turn is subjected to appropriate heat treatment for management of microstructure of the steel sheet, thereby providing desired mechanical properties to the steel sheet.

Figure 3:
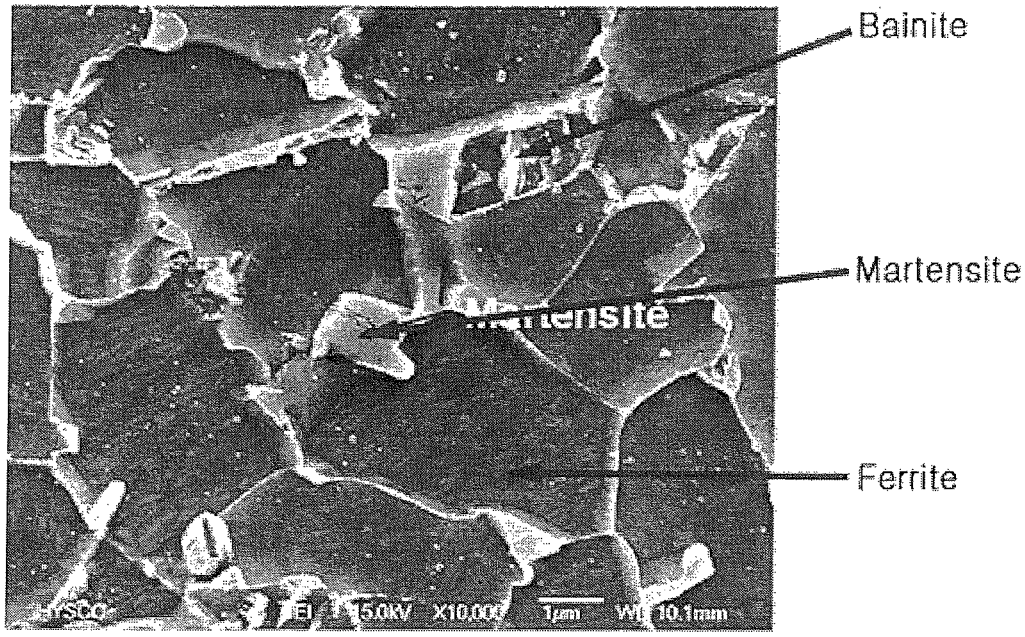
FIG. 3 is a micrograph of the dual phase steel sheet after annealing, in accordance with the present invention.

FIG. 3 is a micrograph of a dual phase steel sheet after annealing in accordance with the present invention.

Referring to FIG. 3, it can be seen that the dual phase steel sheet according to the invention has ferrite and martensite phases and mechanical properties of the dual phase steel sheet are exhibited by a third phase, that is, bainite, and precipitates.

Preferably, the steel sheet has ferrite as a main phase and martensite as a secondary phase in a volume fraction of 5~20%. When the volume fraction of martensite is less than 5%, desired high tensile strength is not be guaranteed, and when the volume fraction of martensite exceeds 20%, the elongation is rapidly deteriorated. Further, when the steel sheet contains bainite in a volume fraction less than 5% in addition to martensite as the secondary phase, it is possible to guarantee desired mechanical properties that the invention is intended to achieve.

In addition, when adjusting a post over-aging section (OAS) temperature in the range of 460~540° C., the formation of martensite can be controlled according to an austenite fraction adjusted in a dual phase region, fine microstructure can be obtained through nucleation, and carbon and other impurities in ferrite are gathered in grain boundaries to develop martensite, whereby soft ferrite becomes more ductile and hard martensite is further chemically stabilized, thereby improving the mechanical properties.

As such, the dual phase steel sheet according to the invention has a dual phase of ferrite and martensite, and guarantees high yield strength in a level of 440~590 MPa, excellent formability, bake hardenability and dent resistance. Further, the dual phase steel sheet has plating characteristics without surface defect by suppressing surface enrichment.

Therefore, the dual phase steel sheet according to the invention enables weight reduction through thickness decrease while enhancing quality through enhancement in dent resistance and flexure reduction.

Although some embodiments have been provided to illustrate the invention, it will be apparent to those skilled in the art that the embodiments are given by way of illustration only, and that various modifications, changes and variations can be made without departing from the spirit and scope of the invention. The scope of the invention should be limited only by the accompanying claims.

What is claimed is:

1. A method of manufacturing a dual phase steel sheet for interior and exterior panels of automobiles, comprising:

reheating a steel slab, the steel slab comprising C: 0.05~0.10% by weight (wt %), Si: 0.03~0.50 wt %, Mn: 1.50~2.00 wt %, P: greater than 0 wt %~0.03 wt %, S: greater than 0 wt %~0.003 wt %, Al: 0.03~0.50 wt %, Cr: 0.1~0.2 wt %, Mo: 0.1~0.20 wt %, Nb: 0.02~0.04 wt %, B: greater than 0 wt %~0.005 wt %, N: greater than 0 wt %~0.01 wt %, and the balance of Fe and other unavoidable impurities;

hot-rolling the steel slab to prepare a hot-rolled steel sheet;

coiling the hot-rolled steel sheet to prepare a hot-rolled coil;

pickling and cold-rolling the steel sheet after uncoiling the hot-rolled coil to prepare a cold-rolled steel sheet; and annealing the cold-rolled steel sheet to prepare an annealed steel sheet having a dual phase, wherein the annealing is performed on a continuous annealing line, the continuous annealing line including an annealing line on which the steel sheet is heated to a temperature of 750~850° C. at 10~20° C./sec and annealed for 100~110 seconds, a cooling line on which the annealed steel sheet is cooled to 460~540° C. at 3~15° C./sec, and an over-aging line on which the cooled steel sheet is subjected to over-aging at 460~540° C. for 100~200 seconds.

2. The method of claim 1, wherein the steel slab is produced by preparing molten steel through a steel making process, followed by making an ingot using the molten steel or continuous casting the molten steel.

3. The method of claim 1, wherein the reheating is performed at 1150~1250° C. for 1.5~3.5 hours.

4. The method of claim 1, wherein the hot rolling is five-pass hot rolling performed at 800~900° C.

5. The method of claim 1, wherein the coiling is performed at 550~650° C.

6. The method of claim 1, wherein the cold-rolling is performed at a reduction ratio of 50~80%.

7. The method of claim 1, further comprising: hot-dip galvanizing the annealed steel sheet at 480~560° C.

8. The method of claim 1, wherein the continuous annealing line is operated at a line speed (L/S) of 80~200 mpm.

* * * * *